US008622125B2

(12) United States Patent
Weirich et al.

(10) Patent No.: US 8,622,125 B2
(45) Date of Patent: Jan. 7, 2014

(54) APPARATUS AND METHODS FOR ALLOWING FLUID FLOW INSIDE AT LEAST ONE SCREEN AND OUTSIDE A PIPE DISPOSED IN AN WELL BORE

(75) Inventors: John Weirich, Shreveport, TX (US); Francisco A. Pineda, Houston, TX (US)

(73) Assignee: Superior Energy Services, L.L.C., Harvey, LA (US)

( * ) Notice: Subject to any disclaimer, the term of this patent is extended or adjusted under 35 U.S.C. 154(b) by 0 days.

(21) Appl. No.: 13/194,211

(22) Filed: Jul. 29, 2011

(65) Prior Publication Data

US 2012/0090831 A1 Apr. 19, 2012

Related U.S. Application Data

(62) Division of application No. 12/246,166, filed on Oct. 6, 2008, now Pat. No. 7,987,909.

(51) Int. Cl.
*E21B 43/04* (2006.01)
*E21B 43/08* (2006.01)

(52) U.S. Cl.
USPC ..... 166/235; 166/51; 166/278

(58) Field of Classification Search
USPC ..... 166/278, 235, 51
See application file for complete search history.

(56) References Cited

U.S. PATENT DOCUMENTS 5,333,688 A * 8/1994 Jones et al. ..... 166/278
5,435,393 A 7/1995 Brekke et al.
5,803,179 A * 9/1998 Echols et al. ..... 166/370
5,868,200 A * 2/1999 Bryant et al. ..... 166/51
5,890,533 A * 4/1999 Jones ..... 166/51
5,896,928 A 4/1999 Coon
6,112,815 A 9/2000 Boe et al.
6,371,210 B1 * 4/2002 Bode et al. ..... 166/370
6,405,800 B1 * 6/2002 Walker et al. ..... 166/278
6,464,261 B1 * 10/2002 Dybevik et al. ..... 285/123.15
6,644,404 B2 * 11/2003 Schultz et al. ..... 166/278
6,715,545 B2 * 4/2004 McGregor et al. ..... 166/235
6,719,051 B2 * 4/2004 Hailey et al. ..... 166/278
6,814,139 B2 * 11/2004 Hejl et al. ..... 166/51
7,055,598 B2 * 6/2006 Ross et al. ..... 166/236
7,243,724 B2 * 7/2007 McGregor et al. ..... 166/278
7,296,624 B2 * 11/2007 Rodet et al. ..... 166/278
7,469,743 B2 * 12/2008 Richards ..... 166/242.1
7,543,641 B2 * 6/2009 Contant ..... 166/278
7,644,758 B2 * 1/2010 Coronado et al. ..... 166/205

(Continued)

FOREIGN PATENT DOCUMENTS

WO WO 2007126496 A2 * 11/2007 ..... E21B 33/12

OTHER PUBLICATIONS

Augustine, Jody, et al; "World's First Gravel Packed Uniform Inflow Control Completion"; SPE 103195; 2006; Society of Petroleum Engineers.

(Continued)

*Primary Examiner* — Jennifer H Gay

(57) ABSTRACT

An apparatus for allowing fluid flow inside at least one screen and outside a span of pipe disposed in a well bore includes at least one flow path for fluid entering at least one screen. The flow path extends from the screen(s) along the outside of the pipe at least one desired entry inlet into the pipe without at least substantial entry at any point therebetween.

17 Claims, 4 Drawing Sheets

(56) References Cited

U.S. PATENT DOCUMENTS

| | | | | |
|---|---|---|---|---|
| 7,661,476 | B2 * | 2/2010 | Yeh et al. | 166/278 |
| 7,708,068 | B2 * | 5/2010 | Hailey, Jr. | 166/278 |
| 7,717,178 | B2 * | 5/2010 | Gaudette et al. | 166/278 |
| 7,802,621 | B2 * | 9/2010 | Richards et al. | 166/205 |
| 7,984,760 | B2 * | 7/2011 | Haeberle et al. | 166/278 |
| 7,987,909 | B2 * | 8/2011 | Pineda et al. | 166/278 |
| 2004/0020832 | A1 * | 2/2004 | Richards et al. | 210/106 |
| 2004/0035591 | A1 * | 2/2004 | Echols | 166/386 |
| 2004/0074641 | A1 * | 4/2004 | Hejl et al. | 166/278 |
| 2004/0140089 | A1 * | 7/2004 | Gunneroed | 166/228 |
| 2005/0082060 | A1 * | 4/2005 | Ward et al. | 166/278 |
| 2005/0092488 | A1 * | 5/2005 | Rodet et al. | 166/278 |
| 2006/0076150 | A1 * | 4/2006 | Coronado et al. | 166/386 |
| 2006/0157257 | A1 * | 7/2006 | Ross et al. | 166/386 |
| 2007/0246210 | A1 * | 10/2007 | Richards | 166/56 |
| 2007/0246212 | A1 * | 10/2007 | Richards | 166/227 |
| 2007/0246213 | A1 * | 10/2007 | Hailey | 166/278 |
| 2007/0246407 | A1 * | 10/2007 | Richards et al. | 210/97 |
| 2008/0035330 | A1 * | 2/2008 | Richards | 166/228 |
| 2008/0041588 | A1 * | 2/2008 | Richards et al. | 166/265 |
| 2008/0128129 | A1 * | 6/2008 | Yeh et al. | 166/275 |
| 2008/0236843 | A1 * | 10/2008 | Scott et al. | 166/386 |
| 2008/0314590 | A1 * | 12/2008 | Patel | 166/278 |
| 2009/0008092 | A1 * | 1/2009 | Haeberle et al. | 166/278 |
| 2009/0078428 | A1 * | 3/2009 | Ali | 166/373 |
| 2009/0120647 | A1 * | 5/2009 | Turick et al. | 166/373 |
| 2009/0133869 | A1 * | 5/2009 | Clem | 166/250.15 |
| 2009/0173498 | A1 * | 7/2009 | Gaudette et al. | 166/278 |
| 2009/0218101 | A1 * | 9/2009 | Langlais et al. | 166/313 |
| 2010/0084133 | A1 * | 4/2010 | Weirich et al. | 166/278 |
| 2011/0162840 | A1 * | 7/2011 | Haeberle et al. | 166/278 |

OTHER PUBLICATIONS

Brekke, Kristian and Lien, S.C.; "New, Simple Completion Methods for Horizontal Wells Improve Production Performance in High-Permeability This Oil Zones"; SPE Drilling and Completion; Sep. 1994.

* cited by examiner

APPARATUS AND METHODS FOR ALLOWING FLUID FLOW INSIDE AT LEAST ONE SCREEN AND OUTSIDE A PIPE DISPOSED IN AN WELL BORE

This application is a divisional application of U.S. application Ser. No. 12/246,166, now U.S. Pat. No. 7,987,909, filed on Oct. 6, 2008, which is incorporated by reference in its entirety.

FIELD OF THE INVENTION

The present invention relates generally to fluid flow systems useful in underground wells. In some embodiments, the present invention relates to systems, apparatus and methods capable of allowing fluid filtered through a screen to pass along the outside of a pipe disposed in a well bore to a pipe entry point near the end of the pipe.

BACKGROUND OF THE INVENTION

In subsurface hydrocarbon recovery operations, some situations warrant the communication of fluid within the downhole assembly along the outside of a span of pipe. For example, during circulating gravel packing operations, it is often desirable to recover gravel delivery fluid through one or more fluid entry point at or near the bottom of the pipe. However, the delivery fluid typically initially enters the downhole assembly through screens located along a length of the pipe, requiring the fluid to be able to thereafter travel along the outside of the pipe to the desired entry point(s).

Various challenges may create difficulties in achieving effective fluid flow along the outside of a span of pipe in a well bore. In the gravel packing scenario above, there may be difficulties in directing the screen-filtered delivery fluid along the outside of the pipe to the desired pipe entry point downhole of the screens. For example, the inclusion of inflow ports or devices, such as inflow control devices (ICD), along the length of the pipe assembly may prevent fluid isolation (from inside the pipe) or impede flow along the desired path. For another example, the orientation of the well bore, such as in non-vertical wells or well sections, may hinder the ability of the fluid to flow in the desired path. As used herein, the term "non-vertical well" includes horizontal, lateral, inclined, deviated, directional or similar wells. In particular scenarios involving systems with ICDs deployed in horizontal wells, for example, the free circulating return of gravel pack carrier fluid would be difficult or impossible, preventing complete alpha/beta wave packing. In such instance, the wells would not be fully gravel packed, which can lead to problems during production.

Accordingly, there exists a need for apparatus, systems and methods useful with underground fluid flow systems having one or more of the following attributes, capabilities or features: allows the communication of fluid within a downhole assembly along the outside of a span of pipe disposed in a well bore; allows the communication of fluid in either direction within a downhole assembly along the outside of a span of pipe; allows screen-filtered fluid to pass at least substantially unrestricted past at least one inflow control device along the outside of a length of pipe to a desired pipe entry point near the end of the pipe; allows fluid to pass from the well bore through at least one screen jacket into the pipe at a desired entry point without at least substantial entry into the pipe therebetween; allows the recovery of gravel delivery fluid through one or more fluid entry point at or near the bottom of the pipe during gravel packing operations; allows the recovery of gravel delivery fluid through one or more fluid entry point at or near the bottom of the pipe during gravel packing operations without the need for a wash pipe; allows effective free circulating return of gravel pack carrier fluid during gravel packing operations in non-vertical wells; allows alpha/beta wave gravel packing of non-vertical wells in which ICD type screen assemblies are deployed; or any combination thereof.

It should be understood that the above-described examples, features and/or disadvantages are provided for illustrative purposes only and are not intended to limit the scope or subject matter of the appended claims or any other patent application or patent claiming priority hereto. Thus, none of the appended claims or claims of any related application or patent should be limited by the above discussion or construed to address, include or exclude the cited examples, features and/or disadvantages, except and only to the extent as may be expressly stated in a particular claim.

BRIEF SUMMARY OF THE INVENTION

In some embodiments, the present disclosure involves apparatus useful for allowing fluid flow inside at least one screen and outside a span of pipe disposed in a well bore. The apparatus includes a tubular assembly having an upper portion, a lower portion and a bore extending therebetween. The upper and lower portions and the bore are disposed along a longitudinal axis of the tubular assembly. At least one inlet is formed in the lower portion of the tubular assembly and allows fluid communication between the bore and the exterior of the tubular assembly. At least a first screen is in fluid communication with the well bore and at least partially concentrically surrounds at least part of the tubular assembly. The screen is disposed along the longitudinal axis of the tubular assembly at a location above the inlet.

In these embodiments, at least a first port is formed in the tubular assembly at a location above the inlet. The first port allows fluid communication between the bore and the exterior of the tubular assembly. At least a first ICD at least partially concentrically surrounds at least part of the tubular assembly over the first port, and is disposed along the longitudinal axis of the tubular assembly at a location between the upper end of the first screen and the inlet(s). At least one flow path for fluid entering the screen extends along the exterior of the bore of the tubular assembly at least partially along the longitudinal axis thereof. The flow path is at least substantially fluidly isolated from the port(s) and extends from the first screen to the inlet. Fluid is capable of at least substantially unrestricted flow between the screen(s) and inlet(s) without at least substantially entering the bore of the tubular assembly therebetween.

There are embodiments of the present disclosure involving apparatus useful for allowing the flow of fluid into a fluid flow system disposed in a well bore during gravel packing operations. The apparatus includes a tubular assembly having upper and lower ends and at least one port that allows fluid communication between the interior and exterior of the tubular assembly. A first ICD extends at least partially around at least part of the tubular assembly over at least one port. At least one screen extends around at least part of the tubular assembly over the first ICD. The screen forms an annulus around the tubular assembly. The annulus includes a gap disposed between the screen and the first ICD. At least one inlet is formed in the tubular assembly between the screen(s) and the lower end of the tubular assembly. The inlet is in fluid communication with the annulus and the interior of the tubular assembly. Fluid may flow from the well bore through the screen(s), into and through the annulus, through the gap at least substantially around the first ICD and port(s) and into the tubular assembly through the inlet(s) without the necessity of a wash pipe.

In many embodiments, the present disclosure involves apparatus for allowing the flow of fluid into a fluid flow system disposed in a well bore during gravel packing operations. A tubular assembly has upper and lower ends and at least one port that allows fluid communication between the interior and exterior of the tubular assembly. A first ICD extends at least partially around at least part of the tubular assembly over at least one port. The first ICD includes at least one flow restriction mechanism useful to control the flow of fluid through the port. The first ICD also includes at least one bypass flowway through which fluid may flow at least substantially around the flow restriction mechanism and port.

In these embodiments, at least one screen extends around at least part of the tubular assembly adjacent to the first ICD. The screen forms an annulus around the tubular assembly. The annulus is in fluid communication with the bypass flowway of the first ICD. At least one inlet is formed in the tubular assembly proximate to the lower end thereof below the first ICD and the screen(s). The inlet is in fluid communication with the annulus, the bypass flowway and the interior of the tubular assembly. Fluid may flow from the well bore through the screen(s), into and through the annulus and the bypass flowway and into the tubular assembly through the inlet without the necessity of a wash pipe.

Various embodiments of the present disclosure involve a system useful for allowing fluid filtered through a screen jacket to pass along a length of pipe having multiple ICDs and disposed in a well bore to a desired pipe entry point near the end of the pipe. A tubular assembly includes an upper end, a lower end and a bore extending therebetween. At least one inlet is formed proximate to the lower end of the tubular assembly and allows fluid communication between the bore and the exterior of the tubular assembly. At least one closure member is selectively operable to open and close the inlet(s).

In these embodiments, at least first and second axially aligned screen assemblies each include at least one screen jacket and base pipe. The bore of the tubular assembly extends through each base pipe. Each screen jacket at least partially concentrically surrounds at least part of its associated base pipe. Each base pipe includes at least one port formed therein. The ports are capable of allowing fluid communication between the bore and the exterior of the tubular assembly and are disposed above the inlet. At least first and second ICDs are disposed above the at least one inlet. Each ICD is associated with at least one port and is capable of controlling the flow of fluid therethrough.

Also in these embodiments, at least one fluid communication assembly is disposed between the first and second screen assemblies, is in fluid communication with the first and second screen jackets and is fluidly isolated from the bore of the tubular assembly. At least one flow path extends along the interior of the screen jackets and exterior of the base pipes to the inlet(s). The flow path passes through the fluid communication assembly and either passes through or around the ICDs in at least substantial fluid isolation from the ports. When the inlet is open, the flow path allows fluid to pass from the well bore through the screen jacket(s) and the inlet(s) into the bore of the tubular assembly without at least substantial entry into the bore therebetween.

There are embodiments of the present disclosure that involve methods of allowing gravel packing of substantially the entire well bore annulus around a tubular assembly disposed in a well bore. These methods involve the use of a tubular assembly having at least one closable inlet. The tubular assembly also includes at least one screen and at least one ICD disposed between the inlet and the upper end of the tubular assembly. At least one flow path extends and allows fluid flow between each screen and at least one inlet on the outside of the bore of the tubular assembly. The flow path at least substantially bypasses the flow restriction mechanisms of the ICD(s).

Now in accordance with the methods of these embodiments, with the inlet(s) open, gravel delivery fluid from the well bore is allowed to enter through the screen(s) and into the flow path(s) during the alpha wave formation. The screen filtered gravel delivery fluid is allowed to flow in the flow path(s) outside the bore of the tubular assembly to the inlet(s) and allowed to enter the bore through the inlet(s). After the alpha wave is formed, gravel delivery fluid from the well bore is allowed to enter through the screen(s) and into the flow path(s) during the beta wave formation. The screen filtered gravel delivery fluid is allowed to flow in the flow path(s) outside the tubular assembly bore to the inlet(s) and allowed to enter the bore through the inlet(s). At a desired time, the inlet(s) may be closed, such as to allow formation fluid to pass from the well bore through the screen(s) into the ICDs for controlled entry in the tubular assembly through at least one other entry port.

Accordingly, the present disclosure includes features and advantages which are believed to enable it to advance underground fluid flow technology. Characteristics and advantages of the present invention described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 2:
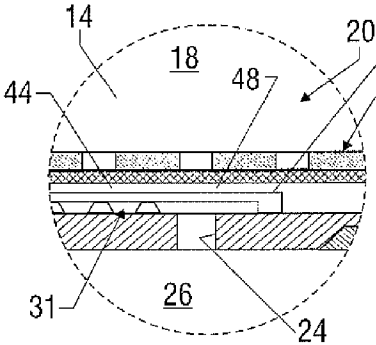
FIG. 2 is an enlarged cross-sectional view of part of the fluid flow system of the embodiment of FIG. 1.

Characteristics and advantages of the present invention and additional features and benefits will be readily apparent to those skilled in the art upon consideration of the following detailed description of exemplary embodiments of the claimed invention and referring to the accompanying figures. It should be understood that the description herein and appended drawings, being of example embodiments, are not intended to limit the appended claims or the claims of any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are identified by like or identical reference numerals or are apparent from the appended drawings themselves. The figures are not necessarily to scale and certain features and certain views of the figures may be shown exaggerated in scale or in schematic in the interest of clarity and conciseness.

As used herein and throughout various portions (and headings) of this specification, the terms "invention", "present invention" and variations thereof are not intended to mean the invention of every possible embodiment of the invention or any particular claim or claims. Thus, the subject matter of each such reference should not be considered as necessary for, or part of, every embodiment of the invention or any particular claim(s) merely because of such reference. Also, it should be noted that reference herein and in the appended claims to components and aspects in a singular tense does not necessarily limit the present invention to only one such component or aspect, but should be interpreted generally to mean one or more, as may be suitable and desirable in each particular instance.

Figure 1:
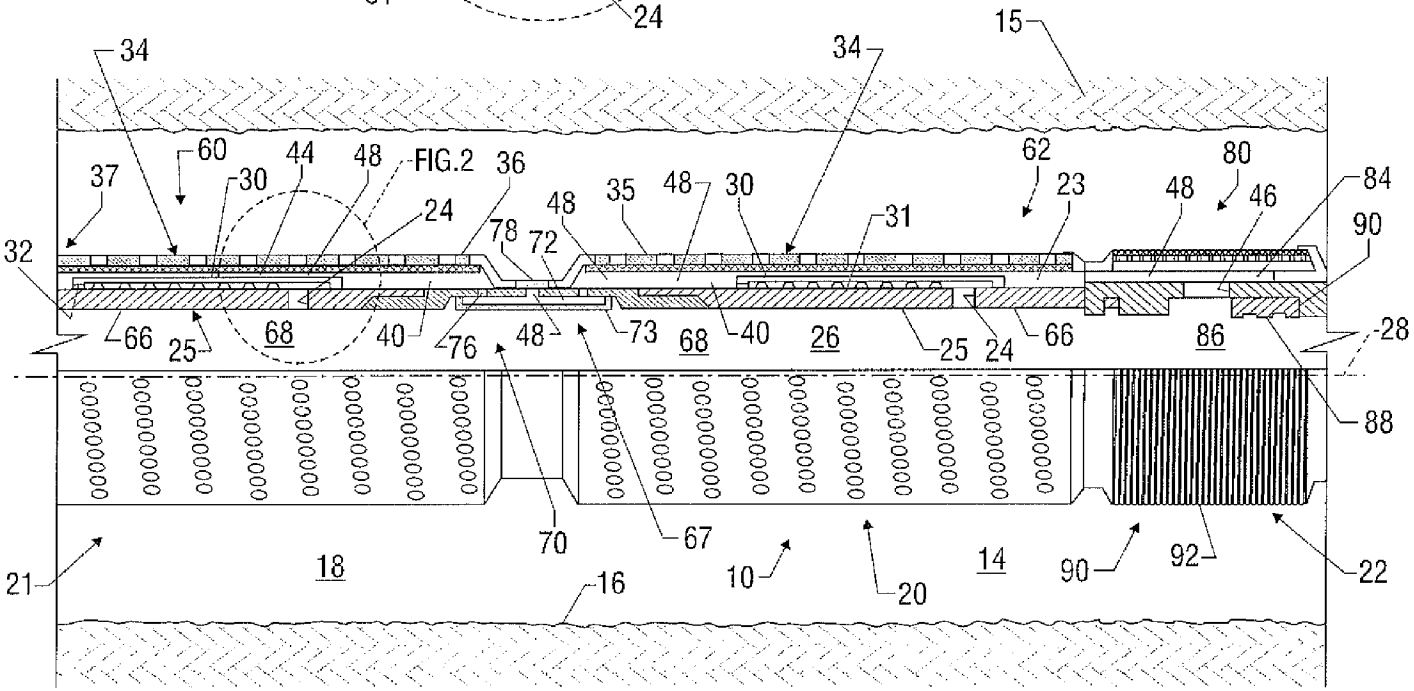
FIG. 1 is a partial cross-sectional view of part of a fluid flow system in accordance with an embodiment of the present disclosure disposed in an exemplary well bore.

Referring initially to FIG. 1, a fluid flow system 10 capable of allowing fluid flow along the exterior of a span of pipe is shown disposed within a well bore 14 formed in or adjacent to an earthen formation 15. In this example, the well bore 14 is a non-vertical, open-hole well having an earthen wall 16. A well bore annulus 18 is formed between the earthen wall 16 and the fluid flow system 10. However, the well bore 14 is not limited to this particular arrangement and orientation. For example, the well bore 14 may be vertical and include a casing. Furthermore, the well bore 14 is in no way limiting upon the present invention.

The illustrated fluid flow system 10 includes a tubular assembly 20 comprising one or more tubular member 25 and generally having an upper portion 21, a lower portion 22 and at least one bore 26 extending therebetween. The bore 26 allows one or more downhole operations to be conducted from the surface, such as, for example, fluid communication, oil/gas recovery and tool deployment as is and becomes further known. The upper and lower portions 21, 22 of the tubular assembly 20 and the bore 26 are disposed along a longitudinal axis 28 of the tubular assembly 20.

At least one inlet 46 is provided in the lower portion 22 of the exemplary tubular assembly 20 and at least one port 24 is formed in the tubular assembly 20 above the inlet(s) 46. The inlet(s) 46 and port(s) 24 are capable of allowing fluid communication between the bore 26 and the exterior 23 of the tubular assembly 20, as described further below and as is or becomes further known.

Still referring to the example of FIG. 1, at least one screen 34 at least partially concentrically surrounds at least part of the tubular assembly 20 and is disposed along the longitudinal axis 28 thereof at one or more respective locations above the inlet(s) 46. The screen 34 typically serves as a filtering medium for fluid entering the tubular assembly 20, as is or becomes further known. For example, in many applications, the screen 34 is useful to assist in preventing sand, gravel and other slurry particles, debris, and/or other materials from entering the tubular assembly 20 from the well bore 14. The screen 34 may have any suitable construction, configuration, operation and other details. For example, the screen 34 may include a multi-layer, premium-type screen 35, a wire wrap or standard screen (not shown) or any other arrangement, as is or becomes known.

In the illustrated embodiment, at least one inflow control device 30 is associated with the tubular assembly 20 and at least one port 24 formed therein. In this example, the ICD 30 concentrically surrounds part of the assembly 20 over the port 24. The ICD 30 is disposed along the longitudinal axis 28 of the tubular assembly 20 at a location above the inlet(s) 46.

The ICD 30 is typically useful during hydrocarbon production operations to limit, control or affect the inflow of formation fluids into the bore 26 of the tubular assembly 20 via the associated port(s) 24, as is and becomes further known. The ICD 30 often includes at least one inflow aperture 32 into the ICD 30 and at least one flow restriction mechanism 31 to affect the fluid flow rate through the port 24. The flow restriction mechanism 31 may include, for example, at least one tortuous flow path, profile arrangement, expandable or swellable member, adjustable throttling or valve device such as a remotely controllable sleeve assembly, or a combination thereof, as is or becomes further known. However, the present invention and appended claims are not limited to any of the above details. As used herein and in the appended claims, the terms "inflow control device" and variations thereof include any one or more devices, features, components or mechanisms disposed between the bore and exterior of a pipe and which in some way affects the flow therebetween.

Further information about various exemplary inflow control devices and their construction, operation and other details may be found in publicly available documents, including, without limitation, U.S. patent application Ser. No. 11/946,638 filed on Nov. 28, 2007, entitled "Flow Restriction Apparatus and Methods" and having a common assignee as this patent, U.S. Patent Application Publication No. US 2007/0246407 to Richards et al., published on Oct. 25, 2007 and entitled "Inflow Control Devices for Sand Control Screens", U.S. Pat. No. 5,435,393 to Brekke et al., entitled "Procedure and Production Pipe for Production of Oil or Gas Fran an Oil or Gas Reservoir" and issued on Jul. 25, 1995, U.S. Pat. No. 5,896,928 to Conn, entitled "Flow Restriction Device for Use in Production Wells" and issued on Apr. 27, 1999, U.S. Pat. No. 6,112,815 to Boe et al., entitled "Inflow Regulation Device for a Production Pipe for Production of Oil or Gas From an Oil and/or Gas Reservoir" and issued on Sep. 5, 2006, SPE 103195 by Jody Augustine et al. entitled "World's First Gravel Packed Uniform Inflow Control Completion," (Copyright 2006, Society of Petroleum Engineers), the Aramco ICD Specifications for Equalizer Type Completion dated Oct. 4, 2006 and entitled "Technical Parameters for ICD (Equalizer) Production System", and the article entitled "New, Simple Completion Methods for Horizontal Wells Improve Production Performance in High-Permeability This Oil Zones" by Kristian Brekke and S. C. Lien published in the September 1994 issue of SPE Drilling and Completion, all of which are hereby incorporated by reference herein in their entireties. It should be noted that nothing contained in any of the above-referenced sources or any other source is limiting upon the present invention.

It should be understood that all of the above-described components and features may have any suitable or desired construction, configuration, components, operation and other details, none of which are in any way limiting upon the present invention unless and only to the extent as may be expressly provided in and with respect to any particular appended claims.

Still referring to the embodiment of FIG. 1, in accordance with the present invention, at least one flow path 48 is provided within the fluid flow system 10 on the exterior 23 of the bore 26 to allow fluid communication between the screen(s) 34 and the inlet(s) 46. The illustrated flow path 48 extends generally from the upper end 37 of the illustrated leftmost screen 36 to the inlet 46. When additional screens (not shown) are included in the tubular assembly 20 uphole of the screen 36, the flow path 48 would similarly extend from the first uphole screen to the inlet(s) 46. Thus, in accordance with the present invention, fluid is at least substantially able to flow between the screens 34 and the inlet(s) 46 external to the bore 26.

The flow path(s) 48 may extend through any desired number and types of components, as long as fluid is able to at least substantially flow between the screen(s) 34 and inlet(s) 46 outside the bore 26. In the particular view of FIG. 1, the exemplary fluid flow system 10 is shown including first and second screen assemblies 60, 62, a fluid communication coupling or assembly 70 allowing fluid communication therebetween and a valve assembly 80 capable of selectively opening and closing the inlet 46. It should be understood that the illustrated arrangement does not necessarily represent an entire fluid flow system 10, which may include other various components. For example, the flow path 48 may extend along more than two screen assemblies and multiple associated fluid communication assemblies.

In this embodiment, each screen assembly 60, 62 includes a base pipe 66, at least one screen 34 and at least one ICD 30. The base pipes 66 each include at least one port 24 and an interior space 68 that forms part of the bore 26 of the assembly 20. In this example, the ICD 30 surrounds at least one port 24, and the screen 34 surrounds the associated ICD 30. An assembly annulus 40 is shown formed between each screen 34 and adjacent base pipe 20. The annulus 40 includes a gap 44 (e.g. FIG. 2) disposed between the screen 34 and the adjacent ICD 30. The assembly annuluses 40 and gaps 44 are part of the illustrated flow path 48. Thus, in this example, when the inlet 46 is open, fluid flowing through either assembly annulus 40 is capable of at least substantially flowing around the corresponding ICD 30 via the gap 44 and into the inlet 46.

The screens 34 and ICDs 30 may be arranged in any other suitable configuration. For example, referring to FIG. 3, the illustrated ICD 30 is not surrounded by a screen 34, but is instead shown sandwiched between the screen 34 of the first screen assembly 60 and the fluid communication assembly 70 along the longitudinal axis 28 of the tubular assembly 20. In this particular arrangement, the ICD 30 is disposed downhole of, or below, the first screen assembly 60 and uphole of, or above, the illustrated fluid communication assembly 70. In other embodiments, the ICD 30 may instead be located downhole of the fluid communication assembly 70. Moreover, the system 10 may include any arrangement of screens 34, ICDs 30 and fluid communication assemblies 70 along the longitudinal axis 28 of the tubular assembly 20.

Figure 3:
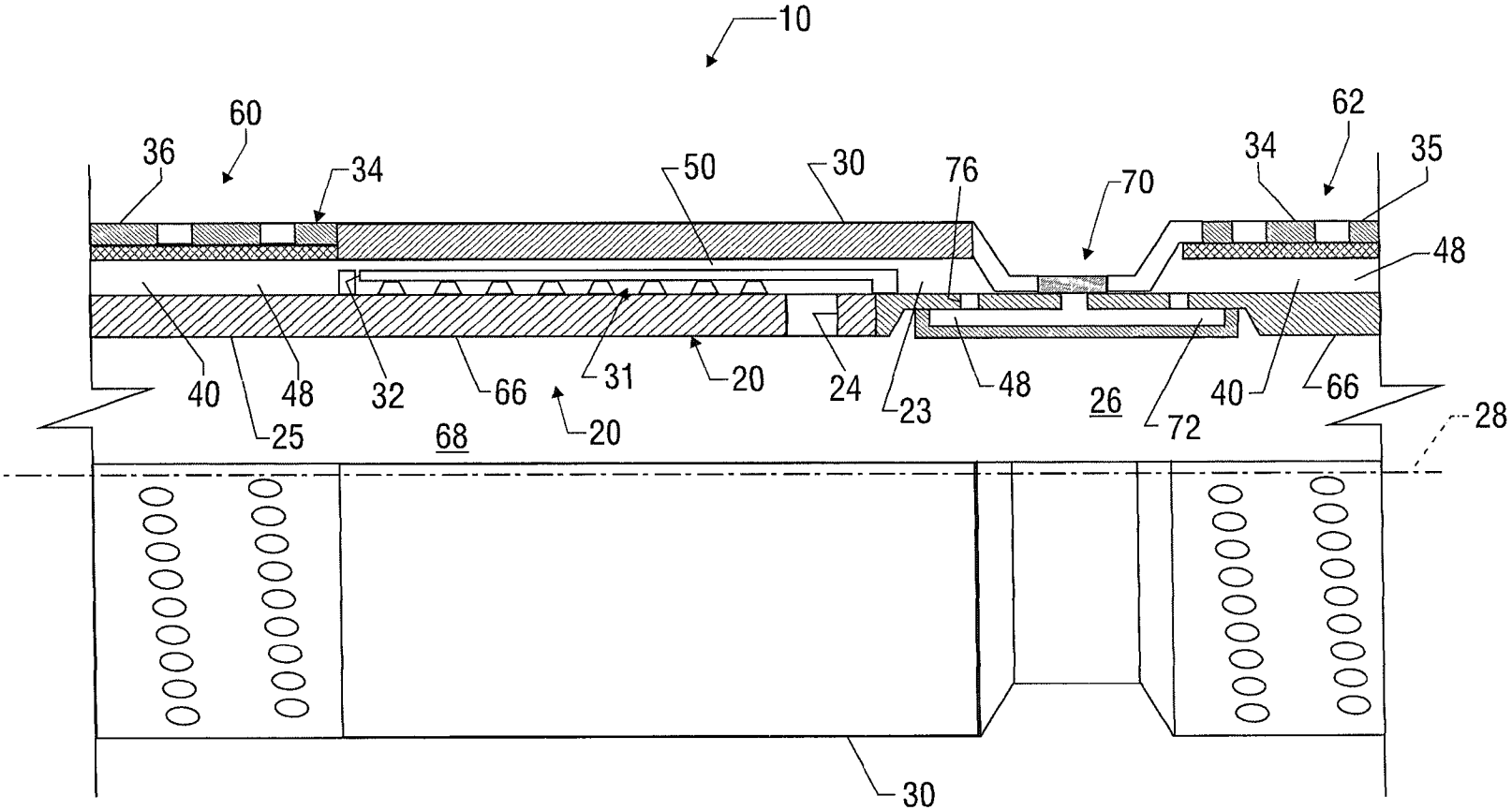
FIG. 3 is a partial cross-sectional view of part of a fluid flow system in accordance with another embodiment of the present disclosure.

Still referring to the embodiment of FIG. 3, the ICD 30 of this embodiment includes a bypass flowway 50 in fluid communication with the adjacent annulus 40. The bypass flowway 50 extends around the inflow aperture 32 and the flow restriction mechanism 31 of the ICD 30 and is part of the flow path 48 of the system 10. Fluid may thus flow in the flow path 48 from the first and second screen assemblies 60, 62 to the inlet 46 without entry therebetween into the tubular assembly 20 through the ports 24.

Referring back to the particular arrangement of FIG. 1, the fluid communication assembly 70, when included, may have any suitable form, construction, components, configuration, operation and other details. In the illustrated example, the fluid communication assembly 70 is disposed between the first and second screen assemblies 60, 62. The assembly 70 provides at least one passageway 72 that fluidly connects the adjacent assembly annuluses 40 and is fluidly isolated from the interior spaces 68 of the respective base pipes 66.

Figure 4:
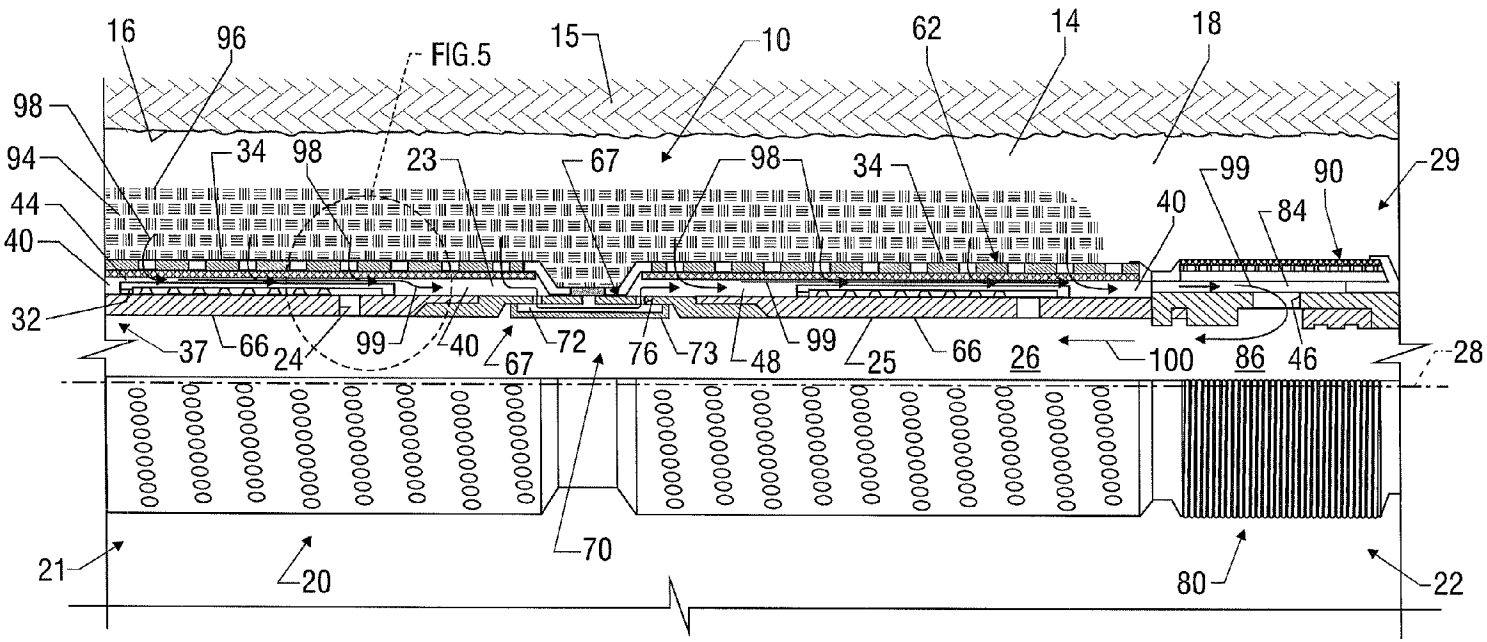
FIG. 4 is a partial cross-sectional view of the fluid flow system of the embodiment of FIG. 1 shown during an exemplary initial phase of gravel packing operations.

In the embodiment shown, the fluid communication assembly 70 includes a sleeve 73 sealingly engaged within the base pipes 66 proximate to their adjacent ends 67 (see e.g. FIG. 4). The illustrated sleeve 73 surrounds at least one passage 76 formed in each base pipe 66 (or an associated component) proximate to the end 67 thereof and is in fluid communication with the corresponding assembly annulus 40. Thus, in this example, the flow path 48 extends between the assembly annuluses 40 of the first and second screen assemblies 60, 62 via the passages 76 in the base pipes 66 (or associated components) and the passageway 72 formed by the fluid communication assembly 70. A coupling 78 is shown extending around the outside of the joint formed between the screen assemblies 60, 62. However, the present invention is not limited to this particular configuration of the fluid communication assembly 70. Moreover, a fluid communication assembly 70 may not be included. Any other mechanism or feature for communicating fluid between screens or other components of a multi-screen arrangement may be used.

Further details and examples of fluid communication assemblies that may be used in connection with the present invention are described and shown in various publicly available documents, including without limitation, the brochure of the present assignee, BJ Services company, entitled "Screen Communication System Product Information" and U.S. Pat. No. 6,405,800 issued on Jun. 18, 2002 to Walker et al., entitled "Method and Apparatus for Controlling Fluid Flow in a Well" and having a common assignee of the present patent, both of which are hereby incorporated by reference herein in their entireties.

Still referring to the embodiment of FIG. 1, the valve assembly 80, when included, may have any suitable form, construction, components, configuration, operation and other details. The illustrated valve assembly 80 is coupled to the lower end of the second screen assembly 62 and includes at least one passageway 84 in fluid communication with the adjacent assembly annulus 40. The valve assembly 80 is also shown having an interior area 86 in fluid communication with the interior space 68 of the second screen assembly 62. Thus, the interior area 86 of the exemplary valve assembly 80 along with the interior spaces 68 of the base pipes 66 form part of the bore 26 of the tubular assembly 20. The inlet 46 of the illustrated system 10 is formed in the valve assembly 80 and fluidly couples the passageway 84 and interior area 86. Fluid may thus flow at least substantially unrestricted between the assembly annuluses 40 into the bore 26 of the exemplary tubular assembly 20 via the passageway 84 and inlet 46.

In this example, the valve assembly 80 also includes a closure member 88 selectively moveable over the inlet 46. The closure member 88 may be useful in some applications, for example, to close the inlet 46 when it is desired to pressurize the flow path 48 and allow production fluid flow from the formation 15 to pass into the inflow apertures 32 of the inflow control devices 30 and ports 24.

The illustrated closure member 88 is a sliding sleeve movable between open and closed positions relative to the inlet 46 in any suitable manner. For example, the closure member 88 may be movable with the use of a mechanical shifting tool or wash pipe (not shown) inserted in the bore 26 and operable as is or becomes further known. However, the closure member 88 may have any other suitable form, configuration and operation. For example, the closure member 88 may be a ball-valve or other type of valve, mechanism or other feature that is hydraulically, electrically, electronically or otherwise actuated. Thus, the present invention is not limited by the construction, components, configuration, operation and other details of the closure member 88. Moreover, a closure member 88 may not be included, and the inlet 46 may be selectively closed or blocked (if desired) in any suitable manner.

Still with reference to FIG. 1, the illustrated valve assembly 80 also includes at least one screen member 90 extending at least partially concentrically around its periphery and in fluid communication with the passageway 84. In this example, the screen member 90 is a wire wrap screen assembly 92, but may have any other suitable form. Thus, fluid may flow directly from the well bore annulus 18 through the screen member 90, into the valve assembly 80 and into the bore 26 of the illustrated tubular assembly 20 via the passageway 84 and inlet 46. However, a screen member 90 may not be included.

In other embodiments, the valve assembly 80 may not comprise a separate component, but may be integral to the second screen assembly 60 or other component. For example, the inlet 46 may be formed directly in the second screen assembly 60 or lowermost tubular member 25 of the system 10 or another component welded to the tubular assembly 20, and a closure member 88 may be associated therewith. Moreover, a valve assembly 80 may not be included.

Figure 5:
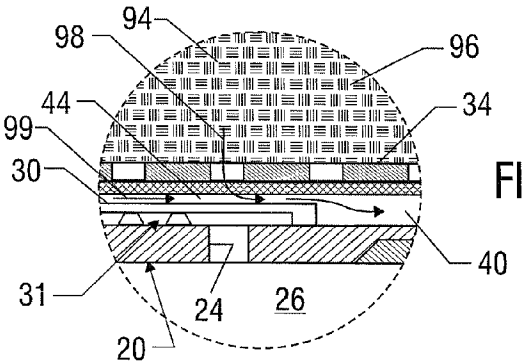
FIG. 5 is an enlarged cross-sectional view of part of the fluid flow system of the embodiment of FIG. 4.
Figure 6:
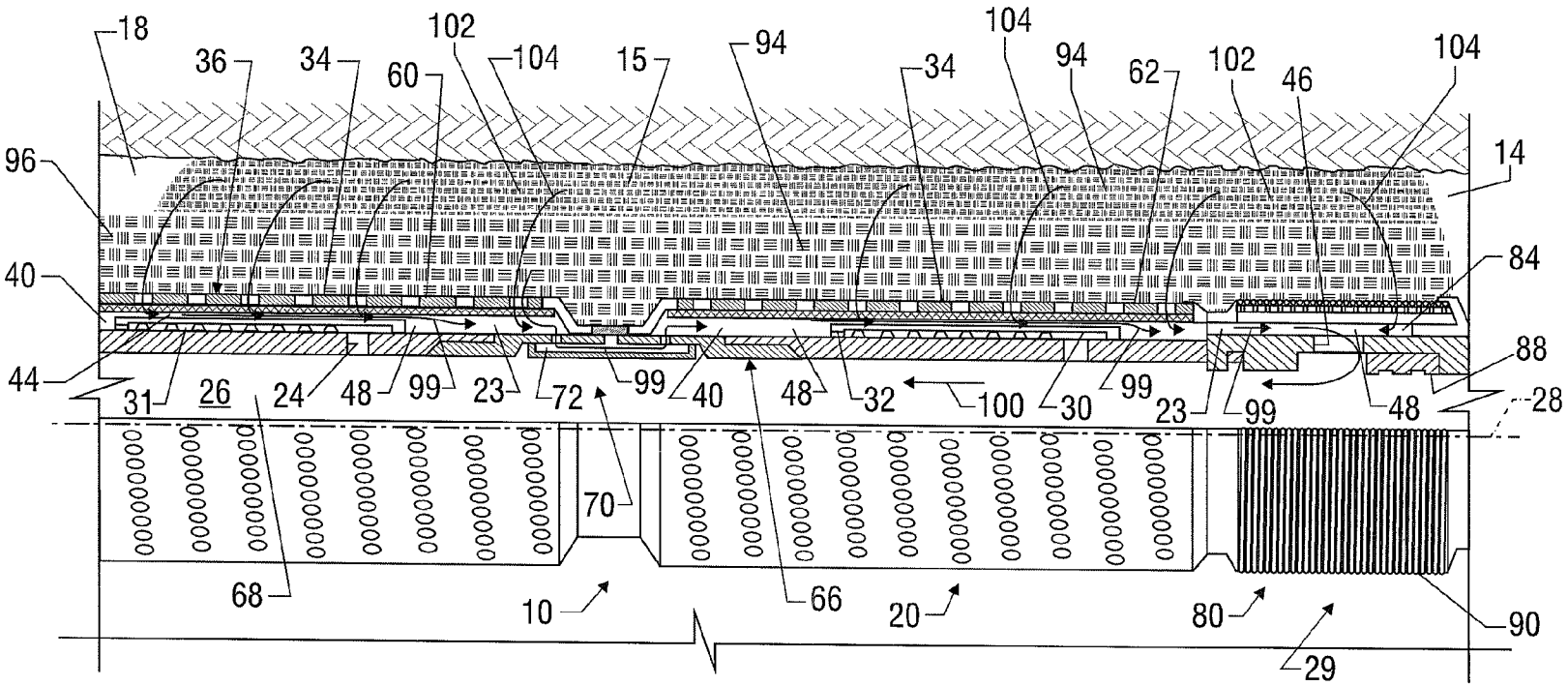
FIG. 6 is a partial cross-sectional view of the fluid flow system of the embodiment of FIG. 4 shown during an exemplary subsequent phase of gravel packing operations.

In another independent aspect, the present invention includes methods of allowing fluid filtered through at least one screen to flow outside the bore of a pipe disposed in a well bore to a pipe entry point at a desired location in the pipe span. An embodiment of a method will now be described with the use of the fluid flow system 10 of FIG. 1 in connection with the recovery of gravel pack delivery fluid during circulating gravel packing operations, as shown in FIGS. 4-6.

However, it should be understood that the illustrated system 10 is not required for practicing this exemplary method or other methods of the present invention or the appended claims. Any suitable components may be used. Further, the present invention is not limited to the particular method as described below, but includes any method of allowing fluid flow within a fluid flow system along the exterior of a span of pipe disposed in a well bore in accordance with the principals of the present disclosure. Moreover, the apparatus, methods and systems of the present invention are not limited to use during gravel packing operations, but may be used in any scenario involving communication of fluid in either direction between the pipe interior and well bore where fluid flow along the exterior of a span of the pipe is desired. A few other examples where the invention may, in some instances, be useful include well stimulation, hole cleaning and fracturing packing.

Referring to the example shown in FIG. 4, in typical gravel packing operations, a gravel slurry, which includes, without limitation, gravel 94 and delivery fluid, is provided through the pipe string into the well bore annulus 18 at or near the heel (not shown) of the well bore 14 or another desired location above the production zone, as is and becomes further know. In the well bore 14 of FIG. 4, the "heel" of the well bore would be somewhere to the left of the upper end 37 of the illustrated leftmost screen 36.

During the insertion of the gravel slurry, gravel 94 from the slurry will typically settle in the well bore annulus 18 along the outside of the tubular assembly 20 beginning near the heel of the well bore 14 and progressing downhole in the well bore 14 along the outside of the tubular assembly 20 toward the toe (not shown) of the well bore 14. In this example, the "toe" of the illustrated well bore 14 would be to the right of the valve assembly 80. This gravel build-up or bank is sometimes known as and referred to herein as the alpha wave 96 and may, for example, fill approximately ¾ of the width of the well bore annulus 18. The alpha wave 96 is shown in FIG. 4 as it progresses down the well bore 14. Typically, the alpha wave 96 continues generally to build up along the length of the tubular assembly 20 to a desired location near the bottom end 29 of the tubular assembly 20, such as at the valve assembly 80.

Still referring to FIG. 4, in accordance with an embodiment of the present invention, as the alpha wave 96 forms, the gravel delivery fluid is capable of substantially flowing into the tubular assembly 20 through the screen(s) 34 (and screen member(s) 90, if included) as indicated by arrows 98. The screens 34, 90 generally prevent the entry of the gravel, sand and other particles or material into the system 10, as is and becomes further known. After entering the screens 34 (and screen assembly 90), the delivery fluid is capable of substantially flowing along the exterior 23 of bore 26 of the tubular assembly 20 through the flow path 48 as indicated by arrows 99. The delivery fluid then enters the bore 26 through the open inlet(s) 46 without at least substantially entering the bore 26 at any intermediate location.

In this particular example, the flow path 48 includes the assembly annuluses 40 of the first and second screen assemblies 60, 62, the respective gaps 44 (see e.g. FIG. 5) and the passageways 72, 84. As shown in FIG. 5, the gap 44 portions of the flow path 48 provide a route for the delivery fluid that at least substantially bypasses the flow restriction mechanism (s) 31 of the ICDs 30 and ports 24. For example, the width of the gap 44 may be substantially greater than the width of the inflow aperture(s) 32 (e.g. FIG. 4) of the ICD 30, allowing the gap 44 to serve as the path of least resistance for fluid flowing through the assembly annulus 40 when the inlet 46 is open. For another example, the entry of fluid into the inflow aperture(s) 32 of the ICDs 30 may require pressurization, which may be avoided when the inlet 46 is open. However, any other suitable conditions, components, features or mechanisms may be utilized to encourage or ensure desired fluid flow in the flow path 48 without passing through flow restriction mechanisms 31 of the ICDs 30 or ports 24.

In this example, there is no need for a wash pipe (not shown) or other component to assist in blocking ports 24 or other intermediate entry points into the bore 26, or to otherwise encourage fluid flow along the exterior 23 of the tubular members 25 to the inlet 46. After passing through the inlet(s) 46, the delivery fluid may then flow up the bore 26 as indicated by arrows 100 to the surface (not shown) or otherwise as desired.

Now referring to the exemplary illustration of FIG. 6, if it is desirable to substantially fill the remainder of the width of the well bore annulus 18 with gravel 94 after the alpha wave 96 is formed, the gravel slurry may continue to be provided in the well bore 14, as is or becomes further known. Gravel 94 from the slurry then begins settling in the well bore annulus 18 on top of the alpha wave 96 beginning near the toe (not shown) of the well bore 14 or otherwise generally where the alpha wave 96 ended, forming the second bank, or beta wave 102, of gravel 94.

Still referring to FIG. 6, in accordance with this embodiment, as the beta wave 102 is formed, delivery fluid from the gravel slurry is able to flow through the alpha wave 96 and into the illustrated fluid flow system 10 through the screens 34 (and screen member(s) 90, when included) as indicated by arrows 104. The delivery fluid inside the screens 34 and screen member 90 is then capable of flowing generally unrestricted through the flow path 48 as indicated by arrows 99, to the open inlet(s) 46 and into the bore 26, similarly as described above with respect to the alpha wave 96 and as shown in FIGS. 4 and 5. The beta wave 102 is thus able to progress up the well bore 14 in the direction of the heel (not shown) thereof to potentially cover the entire alpha wave 96 and substantially fill the remainder of the width of the well bore annulus 18.

After the delivery fluid has sufficiently entered the bore 26 (or at any other time), the inlet 46 may be closed or blocked, such as by actuation of a closure member 88. This may be desired, for example, to allow the ICDs 30 to be the active inflow points into the bore 26 for production, or other operations.

It should be noted that in other applications, it may be desirable for fluid flow in the opposite direction through the flow path 48 from the bore 26 of the tubular assembly 20 to the well bore annulus 18. Thus, the present invention is not limited to flow into the bore 26.

Preferred embodiments of the present invention thus offer advantages over the prior art and are well adapted to carry out one or more of the objects of the invention. However, the present invention does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the invention and the appended claims should not be limited to the embodiments described and shown herein.

The invention claimed is:

1. An apparatus for allowing fluid flow inside at least one screen and outside a span of pipe disposed in a well bore, the apparatus comprising:

a tubular assembly having an upper portion, a lower portion and a bore extending therebetween, said upper and lower portions and said bore being disposed along a longitudinal axis of said tubular assembly;

at least one inlet formed in said lower portion of said tubular assembly, said inlet including at least one valve capable of selectively allowing fluid communication between said bore and the exterior of said tubular assembly;

at least a first screen in fluid communication with the well bore and at least partially concentrically surrounding at least part of said tubular assembly, said at least one screen being disposed along the longitudinal axis of said tubular assembly at a location above said at least one inlet, said first screen having an upper end and a lower end;

at least a first port formed in said tubular assembly at a location above said at least one inlet, said first port allowing fluid communication between said bore and the exterior of said tubular assembly;

at least a first inflow control device at least partially concentrically surrounding at least part of said tubular assembly over said first port and disposed along the longitudinal axis of said tubular assembly;

at least one flow path for fluid entering said at least one screen, said at least one flow path extending along the exterior of said bore of said tubular assembly at least partially along the longitudinal axis thereof from said first screen to said at least one inlet;

wherein said at least one inflow control device includes a bypass flowway, whereby said at least one flow path includes said bypass flowway of said at least one inflow control device.

2. The apparatus of claim 1 wherein said valve includes at least one closure member moveable between at least one open and at least one closed position for controlling fluid flow through said at least one inlet.

3. The apparatus of claim 1 wherein said at least one flow path is configured to permit the unrestricted flow of fluid into said bore through said at least one inlet from said at least first screen.

4. The apparatus of claim 1 further including at least first and second said screens and at least first and second said inflow control devices, wherein fluid entering either of said screens flows to said at least one inlet without entering said bore of said tubular assembly at a location therebetween, and further including a flow communication assembly disposed between said first and second screens, said flow communication assembly having at least one passageway, wherein said at least one flow path includes said at least one passageway of said at least one flow communication assembly.

5. The apparatus of claim 1 wherein said tubular assembly includes at least first and second tubular members, wherein said upper portion of said tubular assembly comprises said first tubular member and said lower portion of said tubular assembly comprises said second tubular member, and further including at least one flow communication assembly disposed between said first and second tubular members, wherein said flow path extends through said flow communication assembly without entering said bore of said tubular assembly.

6. The apparatus of claim 5 wherein said at least one inlet is formed in said second tubular member.

7. The apparatus of claim 5 further including a valve assembly associated with said second tubular member, wherein said at least one inlet is formed in said valve assembly, said valve assembly including an interior area in fluid communication with said at least one inlet and said bore of said tubular assembly.

8. The apparatus of claim 7 wherein said valve assembly includes at least one screen member at least partially concentrically surrounding said interior area and being in fluid communication therewith, wherein fluid is capable of entering said interior area through said at least one screen member from the well bore.

9. The apparatus of claim 8 wherein said valve assembly includes at least one closure member useful to open and close said at least one inlet.

10. The apparatus of claim 9 wherein said at least one closure member includes at least one sliding sleeve.

11. An apparatus for allowing the flow of fluid into a fluid flow system disposed in a well bore during gravel packing operations, the apparatus comprising:

a tubular assembly having upper and lower ends and multiple ports allowing fluid communication between the interior and exterior of said tubular assembly;

at least first and second inflow control devices, said inflow control devices extending at least partially around at least part of said tubular assembly over said ports, said inflow control devices including at least one flow restriction mechanism useful to control the flow of fluid through said ports, said inflow control devices also including at least one bypass flowway through which fluid flows at least substantially around said flow restriction mechanisms and said ports;

at least first and second screens extending around at least part of said tubular assembly adjacent to said inflow control devices, said screens forming annuluses around said tubular assembly, said annuluses being in fluid communication with said bypass flowways of said inflow control devices; and at least one inlet formed in said tubular assembly below said inflow control devices and said screens, said at least one inlet in fluid communication with at least one of said annuluses, at least one of said bypass flowways and the interior of said tubular assembly;

a flow communication assembly disposed between said first and second screens, said flow communication assembly having at least one passageway in fluid communication with said annuluses;

wherein fluid flows from the well bore through said screens, into and through said annuluses and said bypass flowways and into said tubular assembly through said at least one inlet without the necessity of a wash pipe; and wherein fluid entering either of said screens flows to said at least one inlet without entering the interior of said tubular assembly at a location therebetween.

12. The apparatus of claim 11 further including at least one valve associated with said at least one inlet, said at least one valve being capable of selectively blocking said at least one inlet.

13. Apparatus for disposing in a well bore, the apparatus comprising:

a tubular assembly comprising an interior tubular bore, an inlet, and a port;

the inlet including at least one valve capable of selectively allowing fluid communication between the tubular bore and an exterior of the tubular assembly;

a screen at least partially concentrically surrounding at least part of the tubular assembly;

the port allowing fluid communication between the tubular bore and the exterior of the tubular assembly;

an inflow control device at least partially concentrically surrounding at least part of the tubular assembly over the port, the inflow control device including a bypass flowway;

at least one flow path for fluid entering the screen, including the bypass flowway, and extending along the exterior of said tubular assembly from the screen to the inlet.

14. The apparatus of claim 13 wherein said valve includes at least one closure member moveable between at least one open and at least one closed position for controlling fluid flow through said inlet.

15. The apparatus of claim 13 wherein said at least one flow path is configured to permit the unrestricted flow of fluid into said bore through said at least one inlet from said screen.

16. The apparatus of claim 13 further including at least first and second said screens and at least first and second inflow control devices, wherein fluid entering either of said screens flows to said inlet without entering said bore of said tubular assembly at a location therebetween, and further including a flow communication assembly disposed between said first and second screens, said flow communication assembly having at least one passageway, wherein said at least one flow path includes said at least one passageway of said flow communication assembly.

17. Apparatus for disposing in a well bore, the apparatus comprising:

a tubular assembly comprising an interior tubular bore, an inlet, and a port;

the inlet allowing fluid communication between the tubular bore and an exterior of the tubular assembly;

a screen at least partially concentrically surrounding at least part of the tubular assembly;

the port allowing fluid communication between the tubular bore and the exterior of the tubular assembly;

an inflow control device at least partially concentrically surrounding at least part of the tubular assembly over the port, the inflow control device including a bypass flowway;

at least one flow path for fluid entering the at least one screen, including the bypass flowway, and extending along the exterior of said tubular assembly from the screen to the inlet;

wherein said tubular assembly includes at least first and second tubular members, wherein said upper portion of said tubular assembly comprises said first tubular member and said lower portion of said tubular assembly comprises said second tubular member, and further including at least one flow communication assembly disposed between said first and second tubular members, wherein said flow path extends through said flow communication assembly without entering said bore of said tubular assembly.

* * * * *